US007381099B1

(12) United States Patent
Rohr et al.

(10) Patent No.: US 7,381,099 B1
(45) Date of Patent: Jun. 3, 2008

(54) EQUIPMENT DOOR PERFORATION PENETRATING CONNECTOR

(75) Inventors: Daniel J. Rohr, Wildwood, MO (US); Gary Ware, Newton, MA (US)

(73) Assignee: American Power Conversion Corporation, West Kingston, RI (US)

( * ) Notice: Subject to any disclaimer, the term of this patent is extended or adjusted under 35 U.S.C. 154(b) by 0 days.

(21) Appl. No.: 11/350,502

(22) Filed: Feb. 8, 2006

(51) Int. Cl.
*H01R 13/64* (2006.01)

(52) U.S. Cl. ..... 439/680; 439/374; 439/928.1

(58) Field of Classification Search ..... 439/680–681, 439/374, 928.1
See application file for complete search history.

(56) References Cited

U.S. PATENT DOCUMENTS 3,491,330 A * 1/1970 Barnhart et al. ..... 439/681
4,543,455 A * 9/1985 Pollerspock ..... 200/50.3
4,590,258 A * 5/1986 Linde et al. ..... 528/189
5,388,995 A * 2/1995 Rudy et al. ..... 439/61
6,347,963 B1 * 2/2002 Falkenberg et al. ..... 439/638
6,506,065 B1 * 1/2003 Castleman ..... 439/157
6,822,466 B1 * 11/2004 Holcombe et al. ..... 324/761

* cited by examiner

*Primary Examiner*—Hien Vu
*Assistant Examiner*—X. Chung-Trans
(74) *Attorney, Agent, or Firm*—Lowrie & Lando & Anastasi, LLP

(57) ABSTRACT

A door penetrating connector assembly for providing electrical connectivity through a perforated equipment rack door includes a first connector that includes first electrical contacts configured and disposed to fit through corresponding holes in the equipment rack door, and a second connector that includes second electrical contacts configured and disposed to receive and make electrical contact with the first electrical contacts, where the connectors are configured to inhibit electrical connection through the holes provided by the door, of the first and second electrical contacts if the connectors are disposed with an undesirable alignment relative to each other.

10 Claims, 6 Drawing Sheets

EQUIPMENT DOOR PERFORATION PENETRATING CONNECTOR

BACKGROUND OF THE INVENTION

Communications and information technology (IT) equipment is commonly designed for mounting to and housed within equipment enclosures often referred to as "racks". Equipment racks are used to contain and to arrange communications and information technology equipment, such as network servers, computers, and uninterruptible power supplies (UPS's). To address lifecycle cost, serviceability, and maintenance concerns of IT installations there is a strong preference in the industry to utilize an industry "standard" rack that benefits from economies of scale for cost and gives compatibility with a wide variety of IT equipment.

In order to reduce downtime and labor costs, there is also a desire to accelerate the speed of deployment of IT equipment installations. Thus, pre-engineered time saving solutions that simplify planning and installation of IT equipment, are often used when available.

Within the telecommunications and information technology industry it is often beneficial or necessary to gain wiring access to components within equipment racks for data and control interfaces. For example, graphical user interfaces and displays may be mounted on the outside of an equipment rack to monitor and/or communicate with various pieces of equipment in the rack.

Existing information technology equipment rack door mount products, such as a mini terminal display, use a special cavity and bezel that is integral to the door, or a special door that can be provided on customized installations. As equipment racks and their associated doors are quite large, shipping and replacing a new door for an existing rack is expensive. Also, having a technician cut a hole in an equipment rack door and custom install an access device is costly and time consuming.

SUMMARY OF THE INVENTION

In general, in an aspect, the invention provides a door penetrating connector assembly for providing electrical connectivity through a perforated equipment rack door, the connector assembly including a first connector that includes first electrical contacts configured and disposed to fit through corresponding holes in the equipment rack door, and a second connector that includes second electrical contacts configured and disposed to receive and make electrical contact with the first electrical contacts, where the connectors are configured to inhibit electrical connection through the holes provided by the door, of the first and second electrical contacts if the connectors are disposed with an undesirable alignment relative to each other.

Implementations of the invention may include one or more of the following features. The first and second connectors include first and second orientation indicators respectively to provide visual indication of proper orientation of the first connector relative to the second connector. The first and second connectors are configured to physically attach to each other only in a desired alignment relative to each other. The first and second connectors include at least one locator pin and at least one corresponding receptacle configured to inhibit reception of the first electrical contacts by the second electrical contacts if the first and second connectors are arranged in other than the desired alignment. The at least one locator pin and at least one corresponding receptacle include multiple alignment locator pins and corresponding receptacles asymmetrically disposed relative to the electrical contacts. The first and second electrical contacts are disposed in two rows of equal number of electrical contacts and where the at least one locator pin and the at least one corresponding receptacle include at least two alignment pins and corresponding receptacles with a first alignment pin and corresponding receptacle closer to a first end of the rows of electrical contacts than a second alignment pin and receptacle are relative to a second end of the rows of electrical contacts.

In general, in a aspect, the invention provides a door penetrating connector assembly for providing electrical connectivity through a perforated equipment rack door, the connector assembly including a first connector that includes first electrical contacts configured and disposed to fit through corresponding holes in the equipment rack door, and a second connector that includes second electrical contacts configured and disposed to receive and make electrical contact with the first electrical contacts, where the first and second connectors include alignment means for inhibiting electrical connection, through the holes provided by the door, of the first and second electrical contacts if the connectors are disposed with an undesirable alignment relative to each other.

Implementations of the invention may include one or more of the following features. The alignment means is configured to physically attach the first and second connectors to each other only in one desired alignment relative to each other. The alignment means includes at least one locator pin and at least one corresponding receptacle configured to inhibit reception of the first electrical contacts by the second electrical contacts if the first and second connectors are arranged in other than a desired alignment relative to each other. The alignment means comprise multiple alignment locator pins and corresponding receptacles asymmetrically disposed relative to the electrical contacts.

In general, in a aspect, the invention provides a door penetrating connector assembly for providing electrical connectivity through a perforated equipment rack door, the connector assembly including a first connector that includes electrical pins arranged in a plurality of rows and configured and disposed to fit through corresponding holes in the equipment rack door, a second connector that includes electrical receptacles arranged in a plurality of rows and configured and disposed to receive and make electrical contact with the electrical pins, where a plurality of attachment pins rotatably held by at least one of the first and second connectors and a plurality of corresponding attachment receptacles provided by at least one of the first and second connectors and configured and disposed to receive the attachment pins, a plurality of alignment pins asymmetrically disposed relative to the attachment pins and receptacles, a plurality of alignment receptacles configured to receive the alignment pins and asymmetrically disposed relative to the attachment pins and receptacles, and where the connectors, including the electrical pins and receptacles and the alignment pins and receptacles, are configured to inhibit electrical connection through the holes provided by the door of the electrical pins and receptacles if the connectors are disposed with an undesirable alignment relative to each other.

Implementations of the invention may include one or more of the following features. The attachment pins and receptacles are symmetrically disposed relative to the electrical pins and receptacles. A printed circuit board is attached to the first connector.

Various aspects of the invention may provide one or more of the following capabilities. Components can be attached to perforated equipment doors without purchasing special doors or cutting holes in the door. Components can be placed at non-standard, nearly-arbitrary locations on a perforated door. Components can be placed on a front or rear door of an equipment rack.

These and other capabilities of the invention, along with the invention itself, will be more fully understood after a review of the following figures, detailed description, and claims.

DETAILED DESCRIPTION OF PREFERRED EMBODIMENTS

Embodiments of the invention provide techniques for attaching components to perforated equipment panels without customization of the panel or use of a special panel. An exemplary embodiment of the invention includes a door panel penetrating connector assembly that includes a host connector, a slave connector, electrical contacts arranged to align with and pass through perforation openings of an equipment rack door panel, and orientation devices. The orientation devices help ensure proper connection of the host and slave connectors. The panel penetrating connector assembly can be attached to equipment panels without purchasing special panels or cutting holes in the panels, and can be placed at non-standard, nearly-arbitrary locations on the panels where sufficient perforations are present. Other embodiments are within the scope of the invention.

Figure 1:
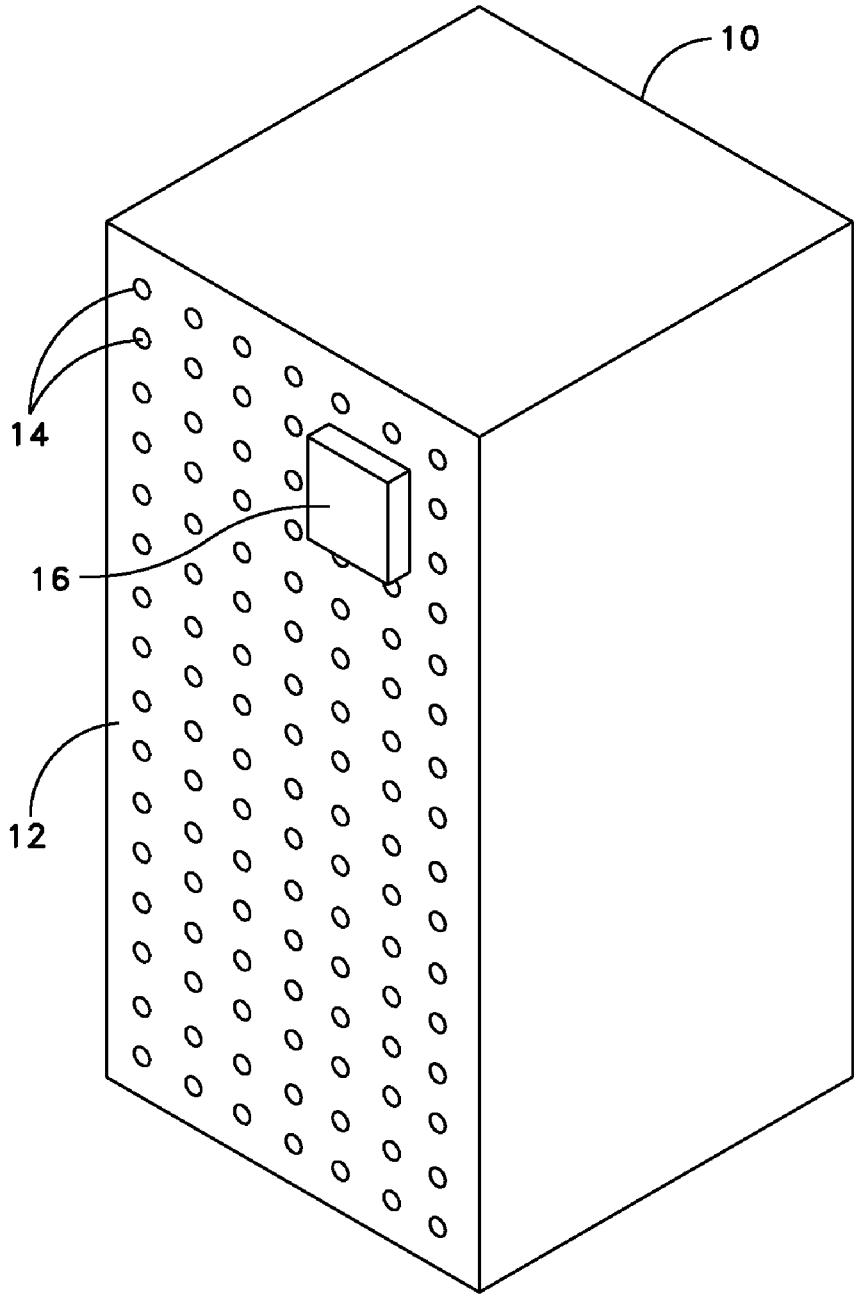
FIG. 1 is a perspective view of an equipment rack and a door penetrating connector.

Referring to FIG. 1, an equipment rack 10 includes a perforated panel, here a door, 12 and a door penetrating connector assembly 16. The door 12 has holes 14 in a standard and uniform pattern. The standard hole pattern specifically has 0.8244 cm horizontal spacing and 0.476 cm vertical spacing, although other hole sizes and/or patterns may be used. The door penetrating connector assembly 16 is connected through the door 12 to provide an electrical wiring contact pass-through to components inside of the equipment rack 10. This connector assembly 16 is not limited to use on a door panel, but could be placed on any perforated panel, e.g., of the equipment rack 10, with which the connector assembly 16 can mate.

Figure 2:
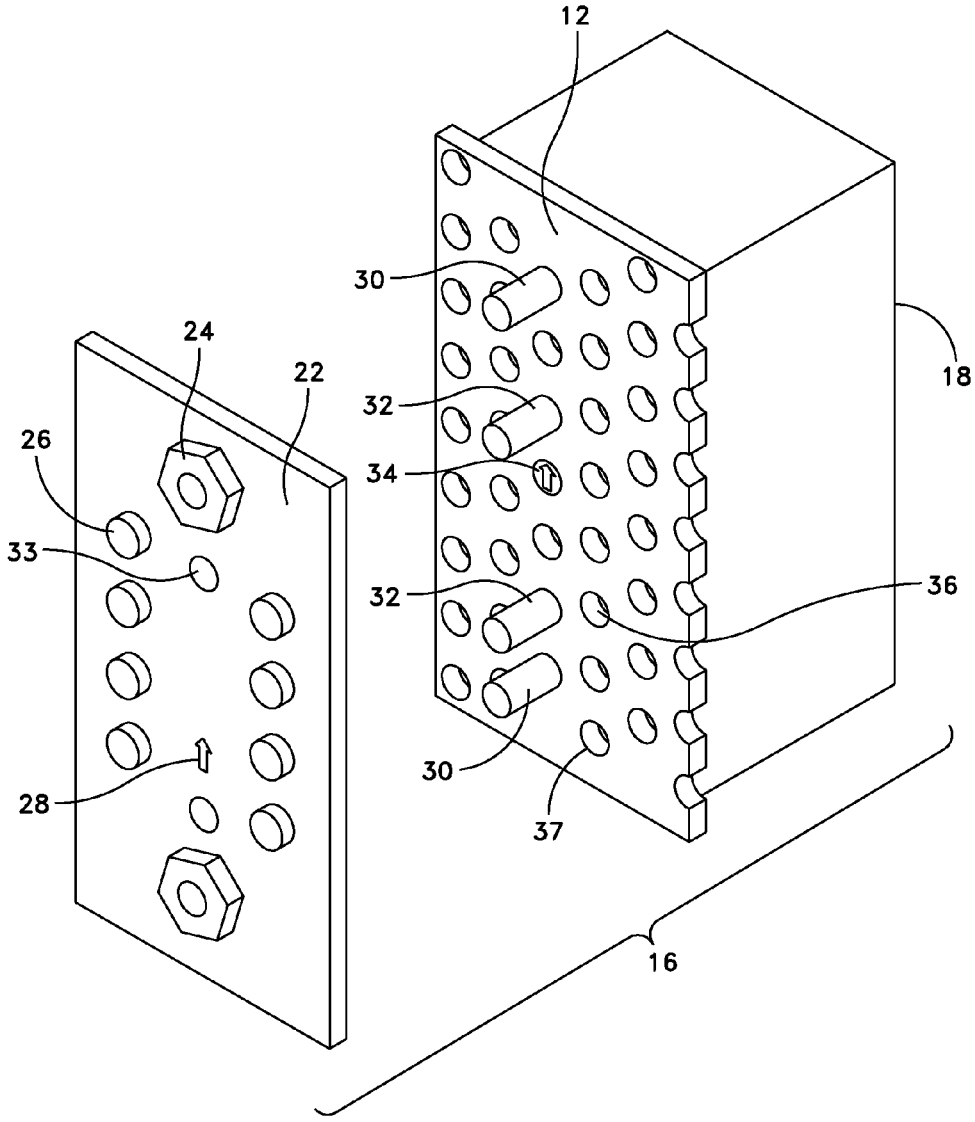
FIG. 2 is a front exploded view of the door penetrating connector and a portion of the perforated equipment rack door shown in FIG. 1.
Figure 3:
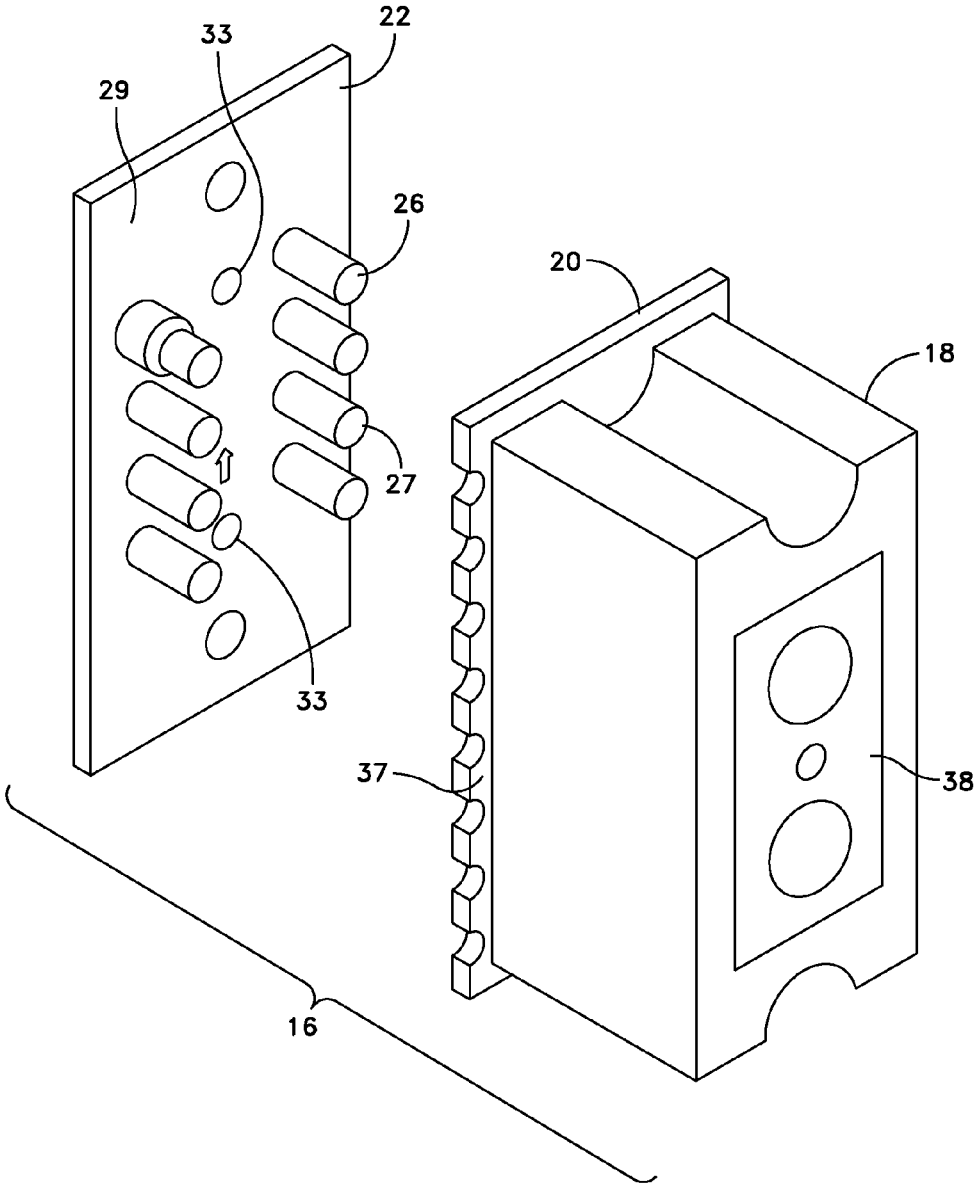
FIG. 3 is a rear exploded view of the door penetrating connector and the portion of the door shown in FIG. 2.

Referring to FIGS. 2-3, the connector assembly 16 includes a host connector 18 and a slave connector 22. The connectors 18, 22 are configured to connect to each other from opposing sides of the perforated equipment rack door 12. The host connector 18 has two captive screws 30, and the slave connector 22 has two captive nuts 24. The screws 30 are disposed, and shafts of the screws 30 are sized, to fit through the holes 14. The screws 30 and the nuts 24 are disposed and configured to mate with each other so that the screws 30 can be screwed into the nuts 24. While two captive screws 30 and two nuts 24 are shown in FIG. 2, other quantities of screws 30 and nuts 24 may be used. Further, non-captive screws and/or nuts may be used. Further, a door penetrating connector assembly could be implemented with no separate mechanical fastening means, instead relying upon friction inherent in a connection of electrical contacts of the connectors 18, 22 when properly mated and in place.

The connectors 18, 22 are configured to make electrical contact through the holes 14 in the door 12. The slave connector 22 includes eight male pins 26 which are disposed relative to each other and configured in size and location to pass through eight of the holes 14 in the perforated door 12. The male pins 26 and the female receptacles 36 are configured to make electrical contact with each other. The pins 26 of the slave connector 22 are configured to plug into the receptacles 36 of the host connector 18. Typically, the male pins 26 are of the type 9-S18141670, Autosplice Inc., San Diego, Calif. The male pins 26 preferably have diameters of about 2.1 mm for use with the holes 14 having diameters of about 4.2 mm. Thus, the pins 26 are preferably less than or equal to about 50% of the holes 14 in diameter. Preferably, there is at least about 1 mm of clearance between the pin 26 and the walls of the door holes 14. Also, there may be an electrically non-conductive sleeve/spacer that is disposed and configured around/about the base of male pin 26 next to a base 29 of the slave connector 22 and/or inside the holes 14 to help ensure that the pin 26 does not make electrical contact with the perforated door panel 12 while the host 18 and slave 22 connectors are properly mated together. The eight male pins 26 are soldered directly to a printed circuit board (PCB), e.g., housed within a graphical user interface or display component. Opposite ends 27 of the pins 26 are male electrical contacts that protrude from a base 29 of the slave connector 22 as shown in FIG. 3. The ends 27 are configured to be inserted into the female electrical receptacles 36 when both of the connectors 18, 22 are properly mated together. The female electrical receptacles 36 may be 770253-3, Tyco Electronics (Amp), Lowell, Mass. These female receptacles 36 provide a proper electrical contact when used with the aforementioned type of male pins 26. Wires can be connected to the female receptacles 36, e.g., by crimping ends of the contacts 36, opposite ends that receive the pins 26, onto the wires.

The host 18 and slave 22 connectors have orientation indicators 34 and 28 respectively. While the orientation indicators can take various physical and visual forms, here the indicators 28, 34 are cut-out arrows that indicate that the proper orientation of the connectors 18, 22 relative to each other is with the indicators 28, 34 aligned as mirror images.

The connectors 18, 22 further include alignment guides to assist with proper alignment, including proper orientation, of the connectors 18, 22. The host connector 18 includes two asymmetrically arranged alignment pins 32, and the slave 22 connector includes two corresponding asymmetrically arranged alignment holes 33 disposed, sized, and arranged to receive the alignment pins 32. The alignment pins 32 and mating holes 33 are disposed asymmetrically relative to the pins 26 and the receptacles 36 to help ensure that the host 18 and slave 22 connectors are mated successfully in one orientation relative to each other (and inhibit connecting if the connectors 18, 22 are improperly aligned). Successful mating of the connectors can occur when the alignment pins 32 fit into the alignment holes 33, and the screws 30 engage the nuts 24. The alignment pins 32 are configured (e.g., arranged and sized) to interfere with a body 29 of the connector 22 to inhibit proper engagement of the screws 30 with the nuts 24 and the male electrical pins 26 with the female receptacles 36 if mating of host and slave connectors 18, 22 is attempted in an improper alignment. The protruding alignment pins 32 preferably extend at least about 1.27 mm further from a base 37 of the connector 18 than the male electrical pins 26. For example, the alignment pins 32 may be about 11.97 mm long, and about 3.8 mm around while the pins 26 are about 10.7 mm long. Further, the number of pairs of alignment pins 32 and holes 33 shown is exemplary and not limiting, with more or fewer being acceptable. Also, the male alignment pins 32 and female alignment holes 33 can be switched with each other to reside on/in the opposite mating connector 18, 22 with the male alignment pins 32 protruding from the slave connector 22, and the female alignment holes 33 provided by the host connector 18.

As shown in FIG. 3, the host connector 18 includes a wire pass through/strain relief 38. The wire pass through/strain relief 38 allows component cables to pass through the connector 18 into the equipment rack 10 (FIG. 1). The component cables can be terminated inside the host connector 18 by being wire crimped to the female receptacles 36. The strain relief 38 will help remove strain on the component wire cables that are connected to the female crimp pins 36 by securing the wire cables and inhibiting them from being pulled out of their mechanical crimps on the female crimp receptacles 36.

Figure 4:
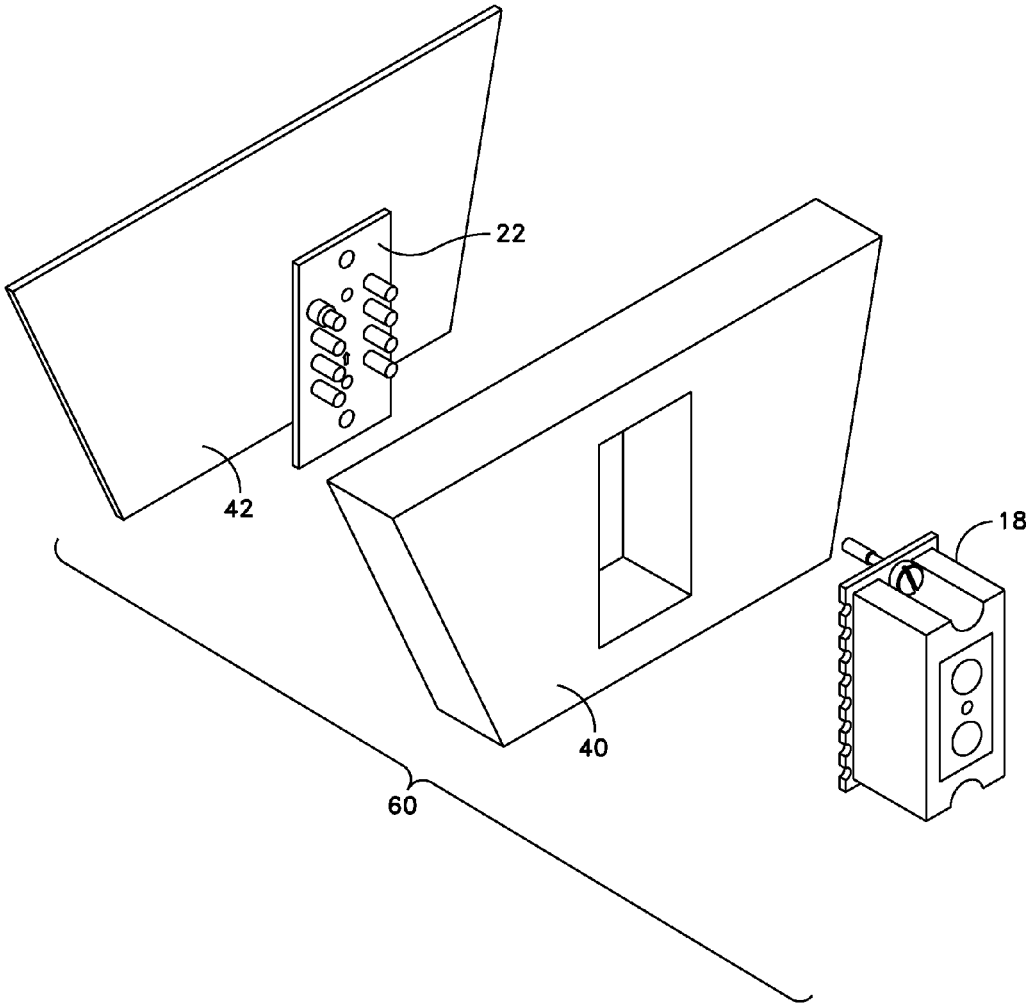
FIG. 4 is a rear exploded view of the door penetrating connector and the portion of door shown in FIG. 2, and a printed circuit board and a printed circuit board product housing.

Referring to FIG. 4, a final assembly 60 includes the equipment door connector 16 and a printed circuit board 42 to which the male electrical pins 26 of the slave connector 22 are soldered and a product housing 40 through which the slave connector 22 passes through to mate to the host connector 18. In the assembly 60, the slave connector 22 is an integral part of a graphical user interface or display component that allows it to plug directly to the host connector 18 through a perforated panel with the appropriate pattern and size holes.

Referring to FIGS. 1-3, the connector 16 can be assembled as follows. Appropriate electrical wires are selected from the components within the equipment rack 10, e.g., to connect to a display or control component. The wires are stripped, prepared, and crimped to the female electrical receptacles 36 that are inserted into the host connector 18. The wire cables are routed through the strain relief 38 of the host connector 18 and back to the components within the equipment rack 10. Appropriate male pins are soldered to appropriate locations on a PCB or other electrical terminating connection (e.g., a pre-soldered PCB may be used). The host connector 18 and the slave connector 22 are aligned relative to each other using the orientation indicators 28,34 and the alignment guides 32, 33. The connectors 18, 22 are mated by pushing them together from opposite sides of the perforated panel/door 12, with the electrical male pins 26 fitting through the holes 14 in the door 12. With the two connectors 18, 22 properly mated together, they are fastened together with the screws 30 and the corresponding nuts 24.

Figure 5:
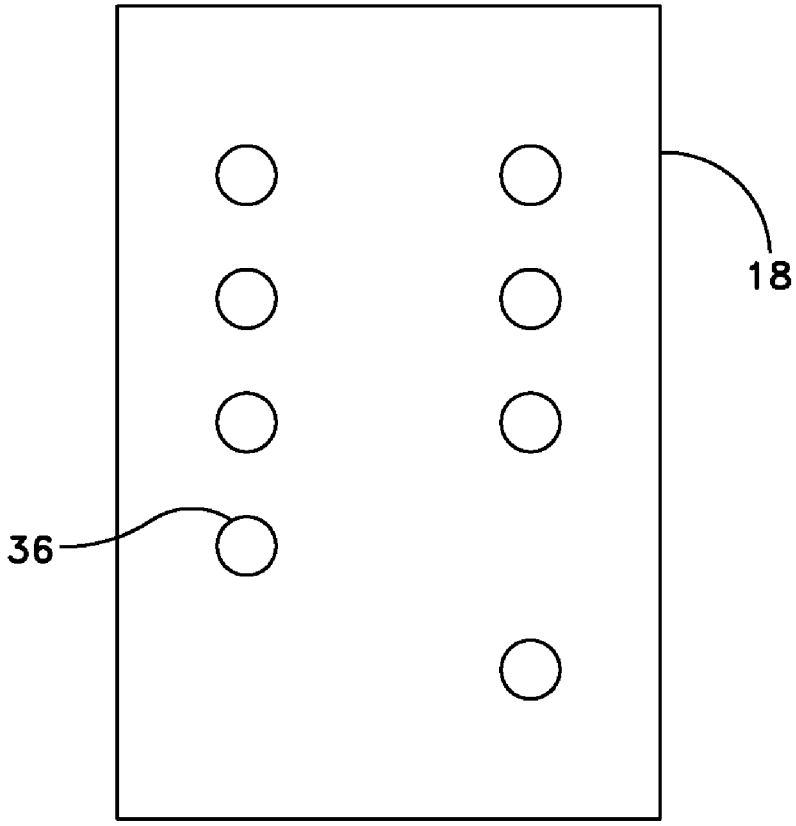
FIG. 5 is a schematic of a host connector with an asymmetric electrical contact arrangement.
Figure 6:
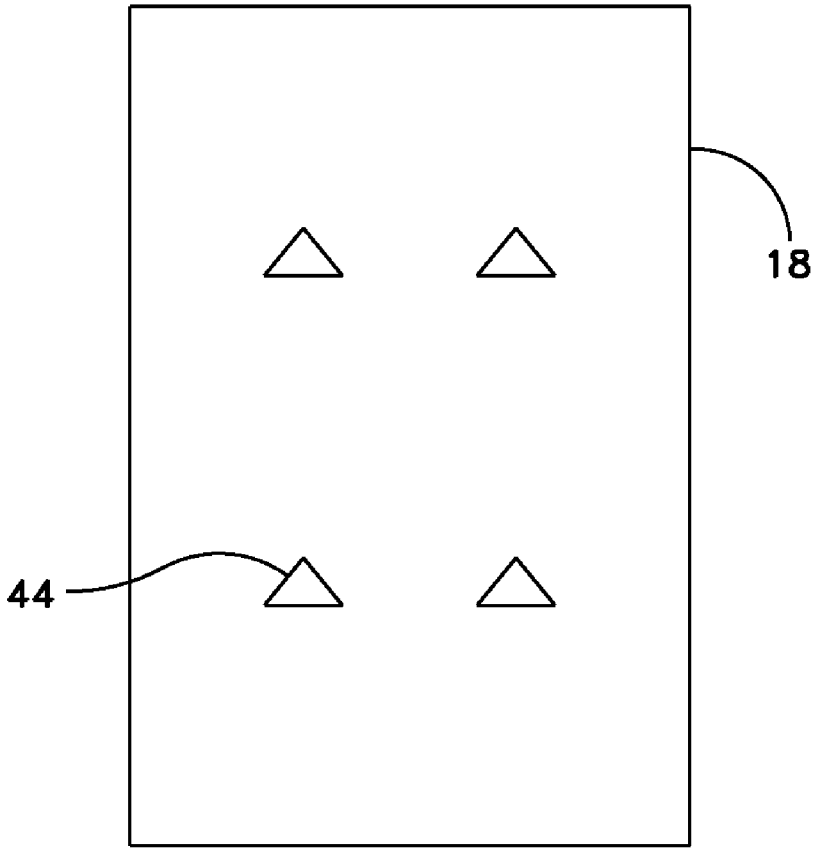
FIG. 6. is a schematic of a host connector with asymmetrically shaped alignment receptacles.

Other embodiments are within the scope and spirit of the appended claims. For example, more or fewer electrical contact pins and receptacles than discussed above could be used. Also, more or fewer attachment fastening screws and nuts could be used. Alignment of host 18 and slave 22 connectors can be provided for using techniques other than those described. For example, other relative placements of the electrical contact pins 26 and receptacles 36 could be used. An asymmetrical arrangement of the electrical pin contacts could be utilized to help ensure mating of the two sides of the connector 10 (host 18, and slave 22) in one orientation. For example, the electrical pin contacts could be arranged in the shape of a trapezoid, provided that the target equipment panel accommodates the chosen pattern. Further, one or more asymmetrically shaped (e.g., trapezoidal) alignment pins and corresponding shaped alignment receptacles could be used. Further, other shapes, (e.g., triangular) of alignment pins and receptacles can be used such that the alignment pin(s) and receptacle(s) inhibit mating of the host 18 and slave 22 connectors in other than a desired relative alignment. Also, the alignment pins and receptacles could be mixed between the connectors 18, 22, e.g., with each connector having one alignment pin and one alignment receptacle (or in other quantities of pins and receptacles). Further, the electrical contacts, e.g., pins and receptacles, could help ensure proper alignment of the host 18 and slave connectors 22, with or without alignment guides. For example, referring to FIG. 5, a host connector 18 could have an asymmetrical layout of receptacles 36. A corresponding slave connector 22 would have a corresponding layout of electrical pin contacts 26. Further, referring to FIG. 6, a host connector could have asymmetrically shaped alignment receptacles 44. A corresponding slave connector 22 would have corresponding asymmetrically shaped alignment pins.

In an alternate embodiment, the male 26 and female electrical contacts 36 could be reversed to reside on the opposite mating connector. The configuration in which the male electrical contacts 26 are on the slave connector 22 enables the display panel 60 can have a thinner profile on the door, since it can be thinner than the depth of the female electrical contacts 36. Further, the physical layout of four rows of two pins/receptacles is exemplary and other arrangements of electrical pins and receptacles could be used that are arranged to fit through the holes 14 in the perforated panel 12 of the equipment rack 10. In addition, the number of electrical pins/receptacles 26, 36 shown is exemplary with more or fewer being possible.

Features implementing functions may also be physically located at various positions, including being distributed such that portions of the functions are implemented at different physical locations.

Further, while the description above refers to the invention, more than one invention may be described.

What is claimed is:

1. A door penetrating connector assembly for providing electrical connectivity through a perforated equipment rack door without the use of special holes or apertures, the rack door having a pattern of vertically and horizontally spaced holes, the connector assembly comprising:

a first connector that includes first electrical contacts each configured and disposed to fit through a separate vertically or horizontally spaced hole in the perforated equipment rack door; and a second connector that includes second electrical contacts configured and disposed to receive and make electrical contact with the first electrical contacts, wherein the connectors are configured to inhibit electrical connection through the holes provided by the perforated equipment rack door, of the first and second electrical contacts, if the connectors are not aligned relative to each other, wherein the first and second connectors are configured to physically attach to each other only in a desired alignment relative to each other, wherein the first and second connectors include at least one locator pin and at least one corresponding receptacle configured to inhibit reception of the first electrical contacts by the second electrical contacts if the first and second connectors are arranged in other than the desired alignment, and wherein the at least one locator pin and the at least one corresponding receptacle comprise at least two alignment pins and corresponding receptacles with a first alignment pin and corresponding receptacle closer to a first end of rows of electrical contacts than a second alignment pin and receptacle are relative to a second end of rows of electrical contacts.

2. The connector assembly of claim 1 wherein the first and second connectors comprise first and second orientation indicators respectively to provide visual indication of proper orientation of the first connector relative to the second connector.

3. The connector assembly of claim 1 wherein the first a second alignment pins and receptacles are asymmetrically disposed relative to the electrical contacts.

4. The connector assembly of claim 1 wherein the first and second electrical contacts are disposed in two rows of equal number of electrical contacts.

5. A door penetrating connector assembly for providing electrical connectivity through a perforated equipment rack door without the use of special holes or apertures, the rack door having a pattern of vertically and horizontally spaced holes, the connector assembly comprising:

a first connector including electrical pins arranged in a plurality of rows, the electrical pins configured to fit through corresponding holes in the perforated equipment rack door; and a second connector that provides electrical receptacles arranged in a plurality of rows and configured and disposed to receive and make electrical contact with the electrical pins;

wherein the first and second connectors are configured to physically attach to each other only in a desired alignment relative to each other:

wherein a plurality of attachment pins are rotatably held by at least one of the first and second connectors and a plurality of corresponding attachment receptacles are provided by at least one of the first and second connectors and configured and disposed to receive the attachment pins;

wherein a plurality of alignment pins are asymmetrically disposed relative to the attachment pins and receptacles;

wherein a plurality of alignment receptacles are configured to receive the alignment pins and asymmetrically disposed relative to the attachment pins and receptacles;

wherein the plurality of alignment pins and the plurality of alignment receptacles include a first alignment pin and corresponding receptacle closer to a first end of rows of electrical contacts than a second alignment pin and receptacle are relative to a second end of rows of electrical contacts: and wherein the connectors, including the electrical pins and receptacles and the alignment pins and receptacles, are configured to inhibit electrical connection through the holes provided by the perforated equipment rack door of the electrical pins and receptacles if the connectors are not aligned relative to each other.

6. The connector assembly of claim 5 wherein the attachment pins and receptacles are symmetrically disposed relative to the electrical pins and receptacles.

7. The connector assembly of claim 6 wherein a printed circuit board is attached to the first connector.

8. The connector assembly of claim 1 wherein the first electrical contacts are configured and disposed to fit through a corresponding subset of a plurality of holes arranged in a two dimensional pattern in the equipment rack door.

9. A system comprising:

a perforated equipment rack panel configured with a symmetric group of holes arranged with uniform spacing in rows and columns across a face of the panel;

a first connector that includes first electrical contacts each configured and disposed to fit through a separate corresponding hole in the equipment rack panel; and a second connector that includes second electrical contacts configured and disposed to receive and make electrical contact with the first electrical contacts, wherein the connectors are configured to inhibit electrical connection through the holes provided by the panel, of the first and second electrical contacts, if the connectors are disposed with an undesirable alignment relative to each other, wherein the first and second connectors are configured to physically attach to each other only in a desired alignment relative to each other, wherein the first and second connectors include at least one locator pin and at least one corresponding receptacle configured to inhibit reception of the first electrical contacts by the second electrical contacts if the first and second connectors are arranged in other than the desired alignment, and wherein the at least one locator pin and the at least one corresponding receptacle comprise at least two alignment pins and corresponding receptacles with a first alignment pin and corresponding receptacle closer to a first end of rows of electrical contacts than a second alignment pin and receptacle are relative to a second end of rows of electrical contacts.

10. The system of claim 9 wherein the perforated equipment rack panel is a door.

* * * * *